United States Patent [19]

Nakahama et al.

[11] Patent Number: 4,767,365

[45] Date of Patent: Aug. 30, 1988

[54] SHIFTING DEVICE FOR INBOARD-OUTBOARD DRIVE

[75] Inventors: Ryoji Nakahama; Naoyoshi Kuragaki, both of Hamamatsu, Japan

[73] Assignee: Shanshin Kogyo Kabushiki Kaisha, Hamamatsu, Japan

[21] Appl. No.: 16,184

[22] Filed: Feb. 17, 1987

[30] Foreign Application Priority Data

Mar. 14, 1986 [JP] Japan ..... 61-56707

[51] Int. Cl.[4] ..... B63H 23/06; B63H 23/30

[52] U.S. Cl. ..... 440/75; 440/86; 192/48.4; 192/48.5; 192/51

[58] Field of Search ..... 440/75, 86; 192/48.4, 192/48.5, 48.8, 51

[56] References Cited

U.S. PATENT DOCUMENTS

| | | | |
|---|---|---|---|
| 1,382,955 | 6/1921 | Clementson | 440/75 |
| 2,751,799 | 6/1956 | Long | 440/86 X |
| 3,183,880 | 5/1965 | Shimanckas | 440/75 X |
| 3,217,688 | 11/1965 | Warburton, II | 440/75 X |
| 3,447,504 | 6/1969 | Shimanckas | 440/75 |

FOREIGN PATENT DOCUMENTS

| | | | |
|---|---|---|---|
| 790804 | 2/1958 | United Kingdom | 440/75 |

*Primary Examiner*—Sherman D. Basinger
*Attorney, Agent, or Firm*—Ernest A. Beutler

[57] ABSTRACT

Several embodiments of outboard drive units of inboard-outboard drives that employ a friction clutch separate from the forward, reverse transmission. In each embodiment, the friction clutch is contained within the outer housing of the outboard drive and is hydraulically actuated by a pump, motor arrangement that is also contained within the outer housing of the outboard drive unit.

21 Claims, 2 Drawing Sheets

SHIFTING DEVICE FOR INBOARD-OUTBOARD DRIVE

BACKGROUND OF THE INVENTION

This invention relates to a shifting device for an outboard drive unit and more particularly to an improved shifting device incorporating a hydraulically operated clutch.

As is well known, many forms of outboard drive units employ forward, neutral, reverse transmissions. Such transmissions are common in both outboard motors and in the outboard drive unit of an inboard-outboard drive. Typically, such a transmission includes a driving bevel gear and a pair of oppositely rotating driven bevel gears that are journaled on a shaft. A dog clutching mechanism is provided for selectively coupling selected ones of the driven bevel gears to the shaft for either forward, neutral or reverse drive. Although such mechanisms have the obvious advantage of simplicity, there are a number of disadvantages to the use of dog clutches. Such clutches are difficult to engage and are also noisy in their operation. This is particularly true when attempts are made to shift the dog clutching element when they are rotating at high speeds. However, the dog clutch mechanism has a particularly advantage in that it is able to effectively transmit high degrees of power.

In connection with inboard-outboard drives, it has been proposed to employ a separate clutch for driving the forward, reverse transmission. By employing such a separate clutch, it is possible to facilitate shifting and the clutch may be of the friction type and can, if desired, be hydraulically operated. However, it has been the conventional practice to mount such clutches directly between the engine and a shaft which extends from the engine through the transom of the watercraft to the remotely positioned outboard drive. As a result, there is a certain degree of complexity in the resulting operation. Furthermore, if some form of interlock is provided between the frictional clutch and the dog clutch of the forward, reverse transmission, the construction obviously becomes very complicated due to the remote positioning of the two transmissions and the fact that they are carried by completely different units of the mechanism.

It is, therefore, a principal object of this invention to provide an outboard drive arrangement that has a separate selectively engageable friction clutch and a forward, reverse transmission both of which are contained within a common housing of the outboard drive.

It is a further object of this invention to provide an improved transmission mechanism for an outboard drive wherein the clutching and shifting arrangements are isolated from each other.

It is a still further object of this invention to provide a simple and yet effective separate transmission and clutching mechanism for a marine outboard drive all contained within a common housing.

It is advantageous to use hydraulic actuations for the clutch of a marine transmission is obvious. The hydraulic mechanism itself tends to smoothen the shifting operation. However, the addition of a further and external pump for operating the clutch as heretofore proposed has obviously complicated the arrangement.

It is, therefore, a further object of this invention to provide an improved and simplified hydraulic clutch actuating mechanism for a marine outboard drive.

SUMMARY OF THE INVENTION

A first feature of this invention is adapted to be embodied in a marine outboard drive having an outer housing containing an input shaft that is adapted to be continuously driven by an engine during engine operation. The outer housing further contains a drive shaft and a selectively operable friction clutch for selectively coupling the drive shaft for rotation with the input shaft. A propeller shaft is provided for driving a propeller and a change speed transmission is contained within the outer drive outer housing for selectively coupling the drive shaft with the propeller shaft for driving the propeller shaft in selected speed ratios from the drive shaft.

Another feature of the invention is adapted to be embodied in a marine outboard drive having an outer housing containing an input shaft that is adapted to be continuously driven by an engine during engine operation and a propeller shaft for powering an associated watercraft. A frictional clutch is interposed between the input shaft and the propeller shaft for selectively driving the propeller shaft form the input shaft. In accordance with this feature of the invention, a hydraulic device is incorporated within the outer housing for selectively actuating the friction clutch. A hydraulic pump is contained within the outer housing and is continuously driven by the input shaft for generating fluid pressure. Means are incorporated within the outer housing for selectively applying the fluid pressure of the fluid pump to the hydraulic device for selectively actuating the friction clutch.

DETAILED DESCRIPTION OF THE PREFERRED EMBODIMENTS

Figure 1:
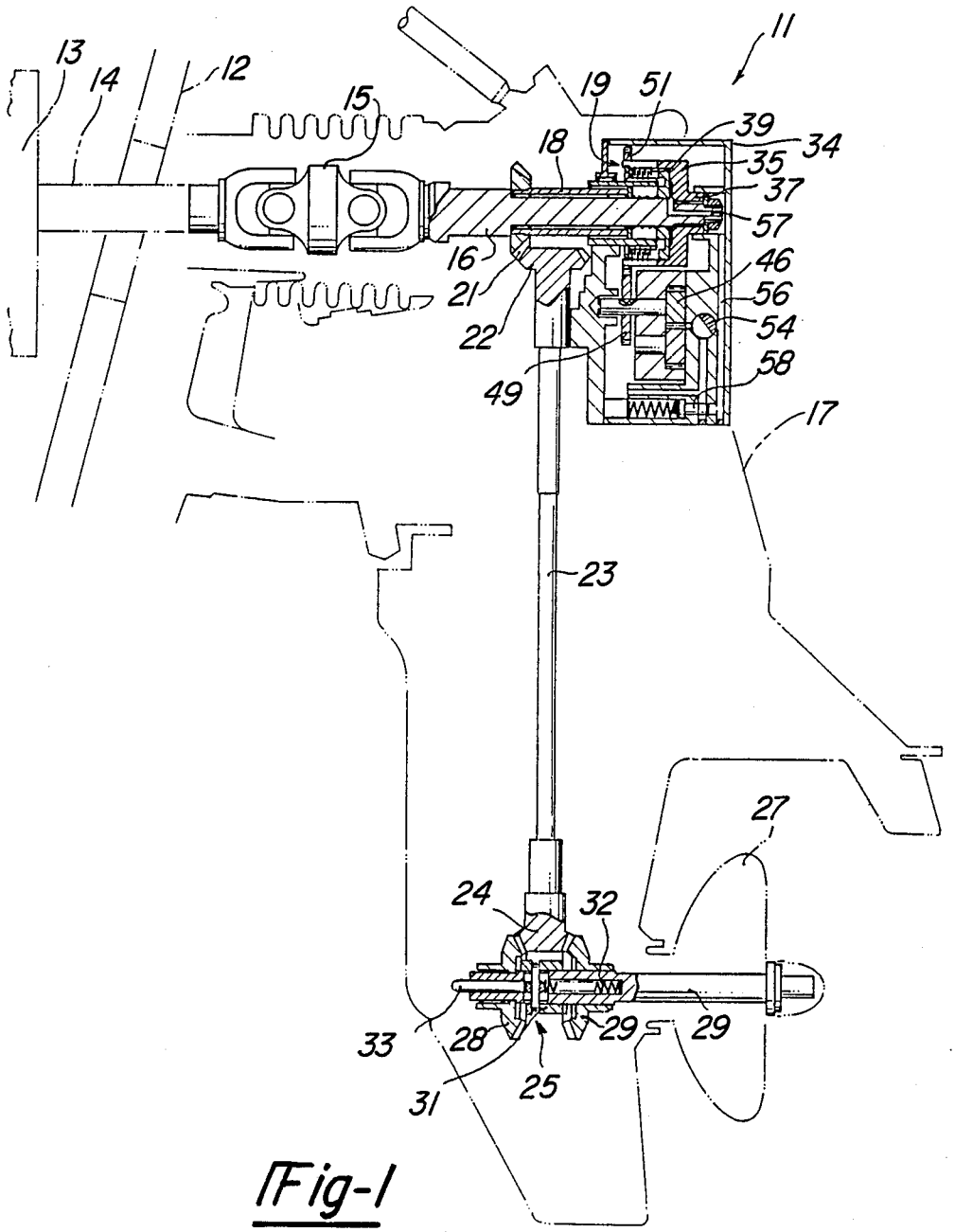
FIG. 1 is a side elevational view of a marine outboard drive constructed in accordance with an embodiment of the invention with portions shown in phantom and other portions broken away and/or shown in section.

Referring now in detail to the drawings and primarily to FIG. 1, a marine outboard drive constructed in accordance with an embodiment of the invention is identified generally by the refernce numeral 11. The outboard drive 11 is, in the illustrated embodiments, the outboard drive portion of an inboard-outboard drive unit. It is to be understood that certain facets of the invention may be employed in connection with outboard motors per se. However, the invention has particular utility in inboard-outboard drives wherein large amounts of power are transmitted and wherein the driving engine is remotely positioned from the drive shaft and propeller shaft. The term "outboard drive" is used herein generically to describe both an outboard motor and the outboard drive portion of an inboard-outboard drive.

In the illustrated embodiment, the outboard drive 11 is associated with a watercraft, which is shown only partially in phantom and which has a transom 12. Contained within the hull of the watercraft is an internal combustion engine 13 which may be of any known type and, for that reason, is shown in phantom. The engine 13 drives an output shaft 14 which extends through the transom 12 and which is coupled by a double Cardan joint 15 to an input shaft 16 of the outboard drive unit 11. The input shaft 16 is suitably journaled within an outer housing assembly of the outboard drive unit 11 which housing assembly is shown in phantom and is identified by the reference numeral 17.

The input shaft 16 drives an intermediate quill shaft 18 through a hydraulically operated, friction clutch assembly, indicated generally by the reference numeral 19. A bevel gear 21 is affixed to the quill shaft 18 and is in constant mesh with a bevel gear 22 that is affixed to the upper end of a vertically extending drive shaft 23. The drive shaft 23 is journaled in a suitable manner within the housing 17 and carries a bevel gear 24 at its lower end which is disposed within the lower unit of the housing 17.

The bevel gear 24 comprises the input gear to a forward, reverse transmission, indicated generally by the reference numeral 25 for driving a propeller shaft 26 in selected forward or reverse directions. A propeller 27 is affixed to the propeller shaft 26 externally of the outer housing 17 for powering the associated watercraft in a known manner.

The forward, reverse transmission 25 comprises a forward bevel gear 28 and a reverse bevel gear 29 which are journaled upon the propeller shaft 26 and in mesh with the bevel gear 24 on opposite sides of the gear 24. As a result of this diametrically opposite positioning of the gears 28 and 29, they will be rotatably driven by the driving gear 24 in opposite directions.

A dog clutching element 31 is splined to the propeller shaft 26 between the gears 28 and 29. The dog clutching element 31 has oppositely facing dog clutching teeth that are adapted to engage corresponding teeth formed integrally on the gears 28 or 29 for selectively coupling one of these gears for rotation with the shaft 26 to drive the shaft. A coil compression spring 32 is received within a bore of the propeller shaft 26 for normally urging the dog clutching element 31 into driving engagement with the forward gear 28. A shift plunger 33 is slidably supported in a bore in the propeller shaft 26 and extends through its forward end for contact with a shift cam (not shown) that is reciprocally supported in the outer housing 17 for urging the dog clutching element 31 rearwardly against the action of the spring 32 into engagement with the gear 29 for effecting reverse movement. This shifting is done when the clutch 19 is disengaged.

Figure 2:
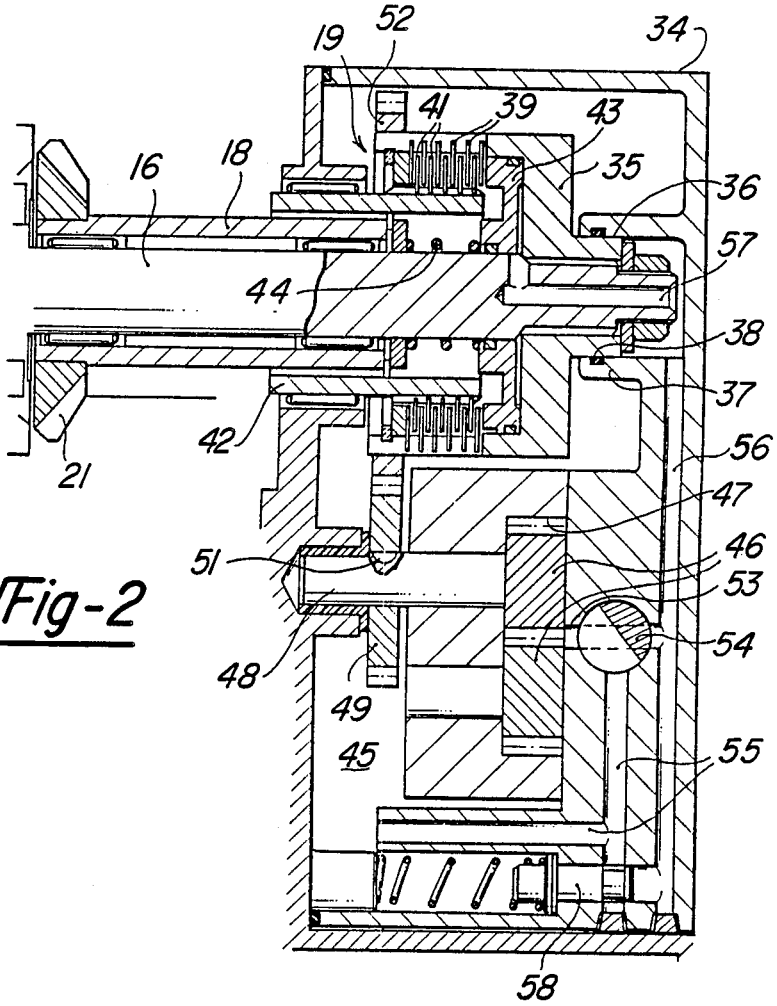
FIG. 2 is an enlarged cross-sectional view showing the construction of the friction clutch and the actuating mechanism for it.

Referring now additionally to FIG. 2, the construction of the clutch 19 and its actuating mechanism will be described. The clutch 19 is contained within a housing 34 which is supported within the outboard drive outer housing 17 in any suitable manner. The input shaft 16 extends into the housing 34 and has splined to its inner end a driving clutch member 35. The clutch member 35 is provided with a cylindrical extension 36 that is journaled within a boss 37 formed on the housing 34. An O-ring seal 38 is received within an internal groove of the boss 37 so as to provide a fluid tight seal with the driving clutch member 35 and specifically with its cylindrical projection 36.

The driving clutch member 35 has a forwardly extending portion that is provided with a plurality of splines that are interengaged with corresponding splines formed on a plurality of driving clutch plates 39. Interposed between the driving clutch plates 39 are a plurality of driven clutch plates 41 that have a splined connection at their inner peripheries to an externally splined sleeve 42. The sleeve 42 is, in turn, provided with internal splines that are engaged with mating splines on the intermediate quill shaft 18 for establishing a driving relationship between the driven clutch elements 41 and the intermediate shaft 18.

A pressure plate 43 is contained within one end of the driving clutch member 35 and is adapted to be hydraulically actuated, in a manner to be described, for bringing the clutch plates 39 and 41 into tight driving engagement. A coil compression spring 44 encircles the input shaft 16 and acts against the pressure plate 41 for urging it to its disengaged position.

The clutch 19 is hydraulically operated by a power source that is contained within the housing 34. This power source comprises a hydraulic pump for delivering fluid under pressure from a reservoir 45 formed within the housing 34 to one side of the pressure plate 43 for urging it against the action of the spring 44 to engage the clutch disks 39 and 41. In this embodiment of the invention, the pump comprises a pair of intermeshing gears 46 that are contained within a pumping cavity 47 formed within the housing 34. A suitable inlet (not shown) connects the pumping cavity 47 with the reservoir 45. One of the gears 46 is affixed to an input shaft 48 to which a gear 49 is affixed, as by means of a key 51. The gear 49 is in mesh with a driving gear 52 that is affixed for rotation with the driving clutch element 35 so that the pump comprised of the gears 46 will be continuously driven as long as the engine 13 is running.

The pump 46 has an outlet port 53 that communicates with a selectively actuatable valve 54. The valve 54 in its closed position directs the outlet of the pump 46 back to the reservoir 31 through a return line 55. In this position, the clutch 19 will be held in a disengaged position by the action of the spring 44.

To engage the clutch 19, the valve 54 is rotated by the operator through a suitable linkage system (not shown) to a position wherein the communication of the pump outlet port 53 with the return passage 55 is closed. In this position, the pump outlet port 53 communicates with a pressure line 56 that extends through the housing 34 and which terminates within the bore formed by the boss 37. The input shaft 16 is provided with a passageway 57 that communicates this bore with the portion of the driving clutch element 35 to the right of the pressure plate 45 so as to act upon the pressure plate 45 and urge it to the left against the action of the spring 44 so as to engage the clutch plates 39 and 41 and effect a driving relationship.

A pressure relief valve 58 is provided in the line 56 and leads back to the reservoir 45 for pressure relief.

In this embodiment, the pump comprised of the gears 46 was driven indirectly through an intermediate gear train comprised of the gears 52 and 49. It is to be understood, however, that one of the gears 46 may be driven directly from the input shaft 16. Alternatively, other types of positive displacement pumps may be employed for actuating the clutch such as a trochoidal gear pump which may be driven either directly from the input shaft 16 or through an intermediate gear train.

Figure 3:
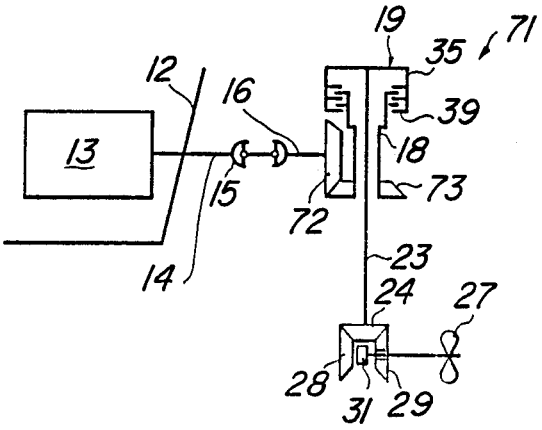
FIG. 3 is a partially schematic view showing a second embodiment of the invention.

In the embodiment of FIGS. 1 and 2, and those alternative embodiments thus far described, the clutch 19 was disposed so that the clutch plates rotated about a horizontally disposed axis and were driven directly from the input shaft 16. FIG. 3 shows another embodiment of the invention in which the major components are the same as the embodiment thus far illustrated and described. However, in this embodiment, the clutch rotates about a vertically disposed axis and is not driven directly by the input shaft. Because of its similarity to the embodiment thus far described, this embodiment is depicted only schematically and those components which are the same ad the components of the embodiment of FIGS. 1 and 2 have been identified by the same reference numeral and will not be described again in detail, except insofar as is necessary to understand the construction and operation of this embodiment.

This embodiment, which is indicated generally by the reference numeral 71, is also depicted as being incorporated within the outboard drive unit of an inboard-outboard drive. In this embodiment, the input shaft 16, which is journaled within an outer housing of the unit (not shown) has affixed to it a bevel gear 72. The bevel gear 72 is in mesh with a bevel gear 73 which rotates about a vertically extending axis. The bevel gear 73 is affixed for rotation with it the quill shaft 18 of the clutch assembly, indicated generally by the reference numeral 19. The clutch assembly 19 is of the same construction as the clutch assembly of the previously described embodiment. The only difference is that the clutch assembly 19 rotates about a vertically disposed axis rather than a horizontally disposed axis. Also, in this embodiment, the quill shaft 18 encircles the drive shaft 23 rather than the input shaft 16. Also, the clutch 19 selectively rotatably couples the quill shaft 18 directly to the drive shaft 23 rather than driving an intermediate shaft as in the previously described embodiment.

Any suitable hydraulic pump arrangement, for example, those of the type previously illustrated and/or described, may be employed for actuating the clutch 19. However, it is preferable that the pump mechanism be contained within the outer housing of the outboard drive unit 71, for reasons already described.

In each of the described embodiments, some form of interlock mechanism may be incorporated for insuring that the forward, reverse transmission 25 cannot be shifted until the clutch 19 is disengaged. Since the transmission 25 and clutch 19 are contained within the same housing, such an interlock is facilitated. There are a wide variety of known mechanisms that may be employed for this purpose.

It should be readily apparent from the foregoing description that a number of embodiments of the invention have been illustrated and described. In each of these embodiments, the clutch mechanism is very compact and is contained within the outboard drive housing 17. Also, the actuating mechanism for this friction clutch is also contained within the outer drive housing 17 so as to provide a compact, unitary assembly. As a result, external linkages are of the miminum and servicing is facilitated.

Although a number of embodiments of the invention have been illustrated and described, various changes and modifications may be made without departing from the spirit and scope of the invention, as defined by the appended claims.

We claim:

1. A marine outboard drive having an outer housing containing a first shaft adapted to be continuously driven at one end thereof by an engine during engine operation, a second shaft, said first and said second shafts being coaxial and telescopic relative to each other with one of said first and second shafts comprising a quill shaft, a selectively operable friction clutch at the other end of said first shaft for selectively coupling said second shaft for rotation with said first shaft, a propeller shaft for driving a propeller and a constant mesh change speed transmission including positive coupling means for selectively coupling said second shaft with said propeller shaft for driving said propeller shaft in selected speed ratios from said second shaft.

2. A marine outboard drive as set forth in claim 1 wherein the change speed transmission comprises a forward, reverse transmission comprised of a driving bevel gear constantly engaged with a pair of counter rotating driven bevel gears and cooperating dog clutching means for selectively driving the propeller shaft in either a forward or a reverse direction.

3. A marine outboard drive as set forth in claim 1 further including a fluid actuator for actuating the friction clutch.

4. A marine outboard drive as set forth in claim 3 wherein the fluid actuator comprises a fluid motor and further including a fluid pump for actuating said fluid motor and contained within said outer housing.

5. A marine outboard drive as set forth in claim 4 wherein the fluid pump operates the fluid motor via a selectively operable control valve contained within the outer housing.

6. A marine outboard drive as set forth in claim 4 wherein the fluid pump is constantly driven.

7. A marine outboard drive as set forth in claim 6 wherein the fluid pump is driven from the first shaft.

8. A marine outboard drive as set forth in claim 7 wherein the friction clutch rotates about a horizontally disposed axis.

9. A marine outboard drive as set forth in claim 7 wherein the friction clutch rotates about a vertically disposed axis.

10. A marine outboard drive as set forth in claim 7 wherein the fluid pump is directly driven by the first shaft.

11. A marine outboard drive as set forth in claim 7 wherein the fluid pump is driven from the first shaft via a gear train.

12. A marine outboard drive as set forth in claim 1 wherein the outboard drive comprises the outboard drive unit of an inboard-outboard drive and wherein the engine is mounted within the hull of the associated watercraft and drives the first shaft through a universal joint.

13. A marine outboard drive as set forth in claim 12 further including a fluid actuator for actuating the friction clutch.

14. A marine outboard drive as set forth in claim 13 wherein the fluid actuator comprises a fluid motor and further including a fluid pump for actuating said fluid motor and contained within said outer housing.

15. A marine outboard drive as set forth in claim 14 wherein the fluid pump operates the fluid motor via a selectively operable control valve contained within the outer housing.

16. A marine outboard drive as set forth in claim 14 wherein the fluid pump is constantly driven.

17. A marine outboard drive as set forth in claim 16 wherein the fluid pump is driven from the first shaft.

18. A marine outboard drive as set forth in claim 17 wherein the friction clutch rotates about a horizontally disposed axis.

19. A marine outboard drive as set forth in claim 17 wherein the friction clutch rotates about a vertically disposed axis.

20. A marine outboard drive as set forth in claim 17 wherein the fluid pump is directly driven by the first shaft.

21. A marine outboard drive as set forth in claim 17 wherein the fluid pump is driven from the first shaft via a gear train.

* * * * *